United States Patent [19]

Murso et al.

[11] 4,072,313

[45] Feb. 7, 1978

[54] TARGET MECHANISM

[75] Inventors: Bernhard Murso, Esslingen-Hegensberg; Eberhard Riedmüller, Seissen, both of Germany

[73] Assignee: Ernst K. Spieth, Zell (Neckar), Germany

[21] Appl. No.: 672,185

[22] Filed: Mar. 31, 1976

[30] Foreign Application Priority Data

Apr. 17, 1975 Germany ..... 2516986

[51] Int. Cl.[2] ..... F41J 9/00

[52] U.S. Cl. ..... 273/105.2; 273/105.6

[58] Field of Search ..... 35/25; 40/32, 36; 46/1 K, 216, 258; 273/102.1 E, 102.4, 105.2, 105.6

[56] References Cited

U.S. PATENT DOCUMENTS

| | | | |
|---|---|---|---|
| 2,703,240 | 3/1955 | Flory | 273/105.2 |
| 2,838,309 | 6/1958 | Merz et al. | 273/105.6 |
| 3,128,096 | 4/1964 | Hammond et al. | 273/105.2 X |
| 3,205,833 | 9/1965 | Fitzpatrick | 46/258 X |
| 3,324,832 | 6/1967 | McCain | 273/105.2 X |

FOREIGN PATENT DOCUMENTS

| | | | |
|---|---|---|---|
| 1,158,410 | 11/1963 | Germany | 273/105.6 |
| 1,200,174 | 9/1965 | Germany | 273/105.6 |
| 348,081 | 9/1960 | Switzerland | 273/105.6 |

*Primary Examiner*—William H. Grieb
*Assistant Examiner*—Vance Y. Hum
*Attorney, Agent, or Firm*—Pollock, Vande Sande & Priddy

[57] ABSTRACT

A target mechanism for shooting at moving targets for a shooting range having station and a target station, and a target cart which moves back and forth on a crossrail between two end positions. By remote control, including a longitudinal guide connected to a target conveyor, the marksman can, without assistance and without leaving his position at the marksman's station, operate the target cart, check his hits and change targets.

13 Claims, 6 Drawing Figures

TARGET MECHANISM

The invention refers to a target mechanism for a shooting range having a marksman's station and a target station, a transverse guide means such as a crossrail mounted on the shooting station transversely to the line of fire, a target cart that runs along the crossrail between two end positions, and a motor-driven transverse drive means that causes the target cart to move in both directions on the crossrail.

Target mechanisms of this sort are designed for shooting at moving targets, especially in certain sports such as shooting at "running boars" from a distance of 10 m with an air gun. Since in this case the target moves alternately from left to right and right to left over the firing zone, a separate target showing the running animal facing in proper direction is required for each direction of motion. Thus, two operating persons are normally needed for the target station to change the target at each end of the path of motion, as well as to indicate the hits.

It is the task of the invention to create a target mechanism of this type that makes it possible for the marksman himself, from the marksman's station, to operate the mechanism, check the number of hits and change the targets, without the help of any additional personnel.

According to the invention, this task is fulfilled in that a target conveyor device, attached to one end of the crossrail, is mounted between the marksman's station and the target station, that the target cart can be moved from the crossrail to the target conveyor device and vice versa, and that the target conveyor device has a longitudinal operating gear for conveying the target cart in both directions between the shooting station and the marksman's station.

There are indeed known target conveying mechanisms that permit moving a target in longitudinal direction from the marksman's station to the target station and vice versa, so that the marksman can check the hits and change the targets, but these target conveying mechanisms do not allow for a lateral movement of the target cart, so that it is not possible to shoot at moving targets.

In the case of the target mechanism according to the invention, the marksman can fit the target cart as desired with targets without moving from his position and then, with the help of the target conveyor device, he can return the target cart to the shooting station. Then, by means of remote control of the motor-driven cross operating gear, he can move the target cart in lateral direction as often as he wishes and shoot at it. To check the hits or change the targets, the marksman needs only to bring the target cart to the level of the target conveyor device and then, with the help of the longitudinal operating gear, bring it to the marksman's station.

A particularly advantageous embodiment of the invention consists in the fact that the target conveyor device comprises a sliding carriage that can be moved along a longitudinal track between the target station and the marksman's station between two end positions, and that is connected with the longitudinal operating gear, and that the sliding carriage is designed to hold the target cart. For this, the sliding carriage preferably has a crossrail section that, in one end position, fits into the extension of the crossrail attached to the target station, and the cross operating gear is designed in such a way that in one end position the target cart is standing on the crossrail section of the sliding carriage.

In this embodiment, the sliding carriage is a part of the crossrail, and the target cart, in its one end position, fits automatically onto the sliding carriage. As soon as the target cart assumes this end position, it is necessary only to activate the target conveyor device to bring the target cart to the marksman's station.

A special embodiment of the target cart makes it possible to change the target automatically at the end of each cross movement of the target cart is such a way that the picture of the running animals is always pointing in the proper running direction. This embodiment is characterized in that a target support, with two target holders attached in fixed manner at right angles to one another, is pivoted to the target cart around a horizontal axis parallel to the crossrail in such a way that said support can assume two positions, in which one or the other of the target holders is in vertical position. Preferably, a device for reversing the position of the target support is located at each end of the crossrail.

In the case of this embodiment, two targets showing the animals running in opposite directions are placed in the target support. Thus, after each cross movement, the two targets are automatically reversed, so that the correct image of the animal running in the proper direction is always seen.

Other advantages and features of the object of the invention can be derived from the following description of an exemplary embodiment, with reference made to the drawings.

Figure 1:
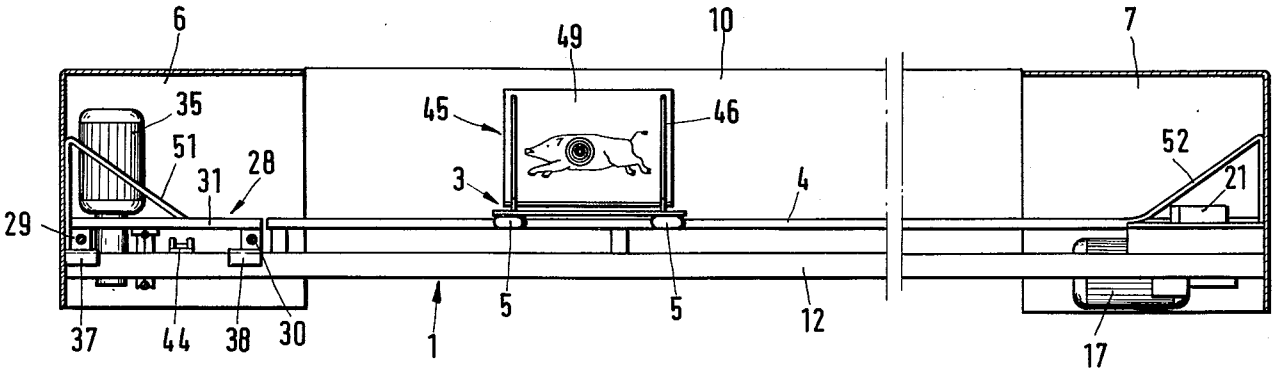
FIG. 1 shows a front view of the target station of the target mechanism according to the invention.
Figure 2:
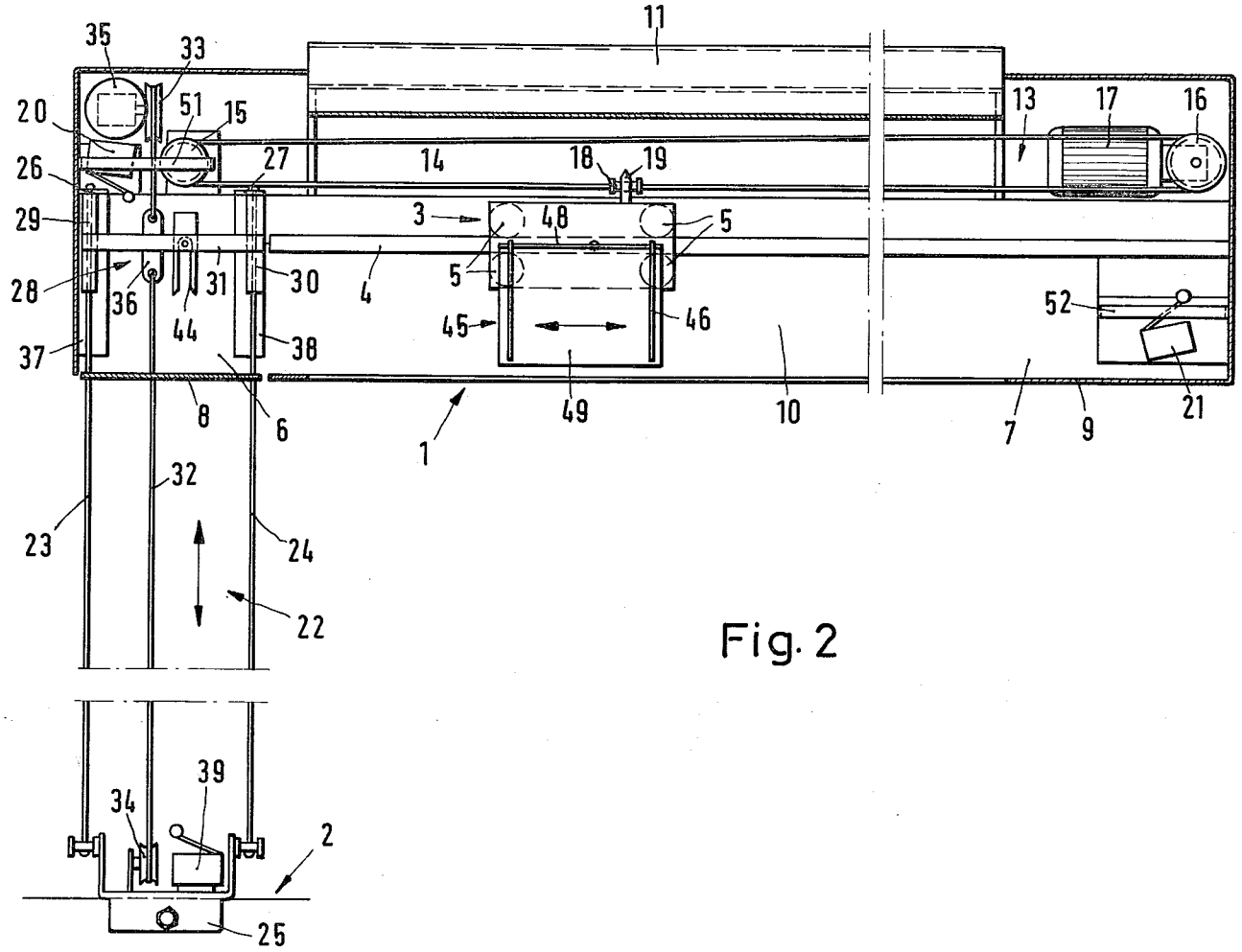
FIG. 2 shows a diagrammatic plan view of the target mechanism according to the invention.

The shooting range for shooting at "running animals" shown in FIGS. 1 and 2 consists of a target station 1 and a marksman's station 2. The distance between the two station corresponds to the prescribed shooting distance, which is 10 m, for example, in the case of air guns.

On the target station 1, a target cart 3 is moved along a track 4 serving as a crossrail by means of rollers 5 in a direction perpendicular to the line of fire between two target houses 6 and 7 located at both ends of the target station. The target house 6 is masked from the marksman's station 2 by a curtain 8, and the target house 7 by a rigid wall 9. The target cart 3, when in either end position following its movement across the target station 1, is lodged in one of the two target houses 6 or 7, in which it is no longer visible to the marksman. Located between the two target houses is the shooting zone 10, behind which is a butt 11. All the parts of the target station are supported on a box girder that extends along the entire length of the target station (FIGS. 3 through 6).

The marksman must shoot at the target carried by the target cart 3 as the target cart moves across the shooting zone 10 at an even speed. The cross movement of the target cart is produced by an operating gear 13. The operating gear 13 has a traction rope 14 that runs parallel to the track 4 and passes over two guide pulleys 15 and 16. The guide pulley 16 is driven by an electric motor 17. Attached to the traction rope 14 is a spool-like cam 18 into which a horizontal shaft 19 attached to the target cart 3 interlocks, so that the target cart 3 is driven in both directions by the traction rope 14.

At the respective ends of the path of travel of the target cart 3 there are limit switches 20 and 21 activated by the target cart 3 as soon as it has reached its end position in target house 6 or target house 7. At the marksman's station 2 there is a push-button (not shown) for activating the cross movement, by means of which the marksman can turn on the electric motor 17. The master switch of the electric motor 17 is designed in such a way that, depending upon the end position in which the target cart is at the moment when the button is pressed, the electric motor turns in the direction corresponding to the direction necessary for moving the target cart to the opposite end position. Furthermore, the master switch has lag elements that activate the electric motor 17 only after a certain predetermined delay after the push-button is pressed, so that after pressing the button the marksman still has time to bring his gun into firing position. Finally, the electric motor 17 can be switched over to various speeds by means of a switch at the marksman's station, so that the target cart 3 is moved across the shooting zone 10 within various prescribed times (e.g., 2.5 and 5 seconds).

The track 4 does not extend over the entire width of the target station, but ends in target house 6 at a distance from the end position about equal to the width of the target cart 3. The remaining space is taken up by a target conveyor device 22, which leads from the target station 1 to the marksman's station 2.

The target conveyor device 22 has two suspension wires 23 and 24 that stretch between an anchor 25 at the marksman's station 2 and two end stops 26 and 27 attached to the crossbeam 12 of the target station 1. A sliding carriage 28 consisting of two gliding members 29 and 30 connected by a track 31 can be moved along these suspension wires. The sliding carriage 28 is moved by a traction rope 32 that passes over two guide pulleys 33 and 34, whereby the guide pulley 33 at the target station 1 is driven by an electric motor 35. The two ends of the traction rope 32 are attached to a pull strap 36 of the sliding carriage 28. The track 31 is identical to the track 4 of the shooting range crossrail, and it is attached to the sliding carriage 28 in such a way that it is an exact extension of the track 4 when the carriage 28 is in its end position on the shooting station, in which the gliding members 29 and 30 abut against the end stops 26 and 27. The proper elevation of the carriage 28 in this end position is assured by two conductor-rail ramps 37 and 38 located in front of the end stops 26 and 27 on the target station. In this end position of the sliding carriage 28, the track 31 forms a part of the crossrail, on which the target cart 3 can move back and forth in lateral direction. In left end position, the target cart 3 stands completely on the track 31 of the sliding carriage 28.

When the target cart 3 reaches this left end position on the sliding carriage 28, it is possible to convey the sliding carriage 28 together with the target cart 3 onto the target conveyor device 22 and thence to the marksman's station 2. For this purpose, there is a second push-button (not shown) at the marksman's station, for longitudinal movement, by which the electric motor 35 can be turned on. Depending upon the end position in which the sliding carriage 28 is at the moment, the electric motor 35 turns in the direction corresponding to the direction in which the sliding carriage must move to reach the opposite end position. When the sliding carriage 28 reaches its end position at the marksman's station 2, a limit switch 39 that shuts off the electric motor 35 is released. When the sliding carriage reaches its other end position on the target station, the electric motor 35 is turned off by means of limit switch 20, which is two-phased and limits both the lateral and the longitudinal movement.

The electric motor 35 of the target conveyor device 22 is designed for two speeds. The master switch of this electric motor is designed in such a way that after the button for longitudinal movement is pressed, the electric motor 35 first starts up at higher speed, in order to move the sliding carriage 28 rapidly over the greater part of the distance between the target station and the marksman's station. At the same time, a timing relay is released, and after a predetermined time it switches the electric motor 35 to the lower speed. This time is measured in such a way that the motor is switched over just when the sliding carriage 28 has almost reached the end position. At this lower speed, the sliding carriage then moves smoothly into end position, where it is stopped by activating the limit switch 20 or 39.

As a safety measure, the master switch is designed in such a way that after a power failure, when the power is restored, the electric motor 35, regardless of the position of the sliding carriage, always starts up again at the lower speed. This avoids the possibility of the sliding carriage being driven at high speed against the stop before the timing relay, started up again, has run out.

Figure 3:
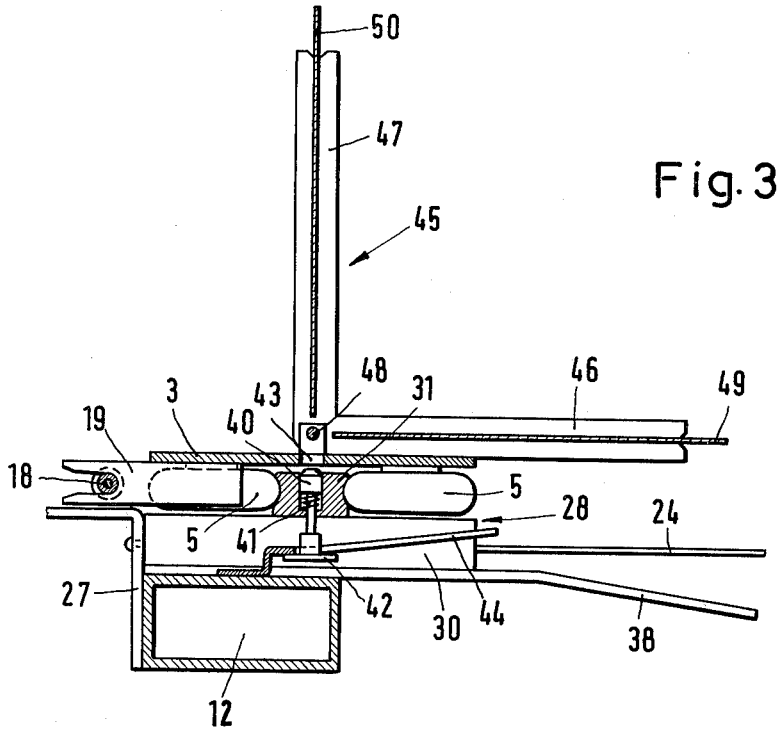
FIG. 3 shows a schematic sectional view of the target cart located in left end position, whereby the stop between the sliding carriage and the target is shown in released position.
Figure 4:
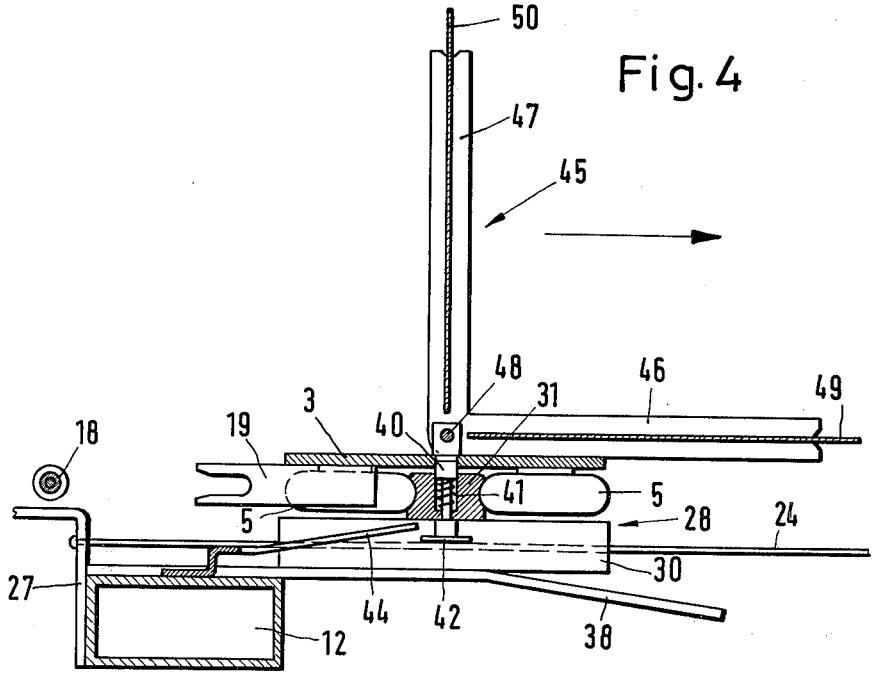
FIG. 4 shows a view similar to that in FIG. 3, shortly after the sliding carriage, with the target cart on it, has left the end position at the target station.

Shown in FIGS. 3 and 4 is a stop device that connects the target cart 3 firmly to the sliding carriage 28 during transport on the target conveyor device 22. This stop device includes a pin 40 that fits into a recess in the track 31 of the sliding carriage 28 and is biased in an upward direction by a spring 41. At its lower end, the pin 40 has a broadened head 42. The target cart has an aperture 43 into which the pin 40 can be inserted. A fork member 44 serving as a guide curve is attached to the box girder 12 is such a way that it interlocks with the head 42 of the pin 40. The fork member 44 is designed is such a way that in the end position of the sliding carriage (FIG. 3) the pin 40 assumes its lowest position, in which it disengages from the aperture 43 in the target cart. The target cart is thus free to move in lateral direction in this position. When, however, the sliding carriage 28 is conveyed to the marksman's station on the target conveyor device and leaves its end position (FIG. 4), the fork member 44 permits the pin 40 to move upward, so that it engages the aperture 43 in the target cart and stops it in a precisely determined position.

From FIGS. 3 and 4, we can also see that, as the sliding carriage 28 leaves the end position, the fork 19 leaves the spool-like cam 18 of the traction rope 14, thereby releasing the connection between the target cart 3 and the operating gear 13. The cam 18 remains in the same position until the target cart 3 is brought back to this end position on the sliding carriage 28. Since the position of the fork 19 is also plainly determined by the pin 40, the fork 19 automatically re-engages with the spool-like cam 18 when the siding carriage 29 moves back into its end position. In this way, the connection between the target cart 3 and the operating gear 13 is automatically re-established, while at the same time the connection between the sliding carriage 28 and the target cart 3 is released by the end-piece fork 44.

As can be seen in the front view in FIG. 1, the target is usually painted with the picture of a running animal, in the present case, the picture of a running boar. It is common, and desirable, to use different targets, showing the animal running in both directions, for both directions of movement of the target cart. A special construction of the target support 45 on the target cart 3 makes it possible to change the targets by completely automatic means, and always to show the animal running in the proper direction.

Figure 5:
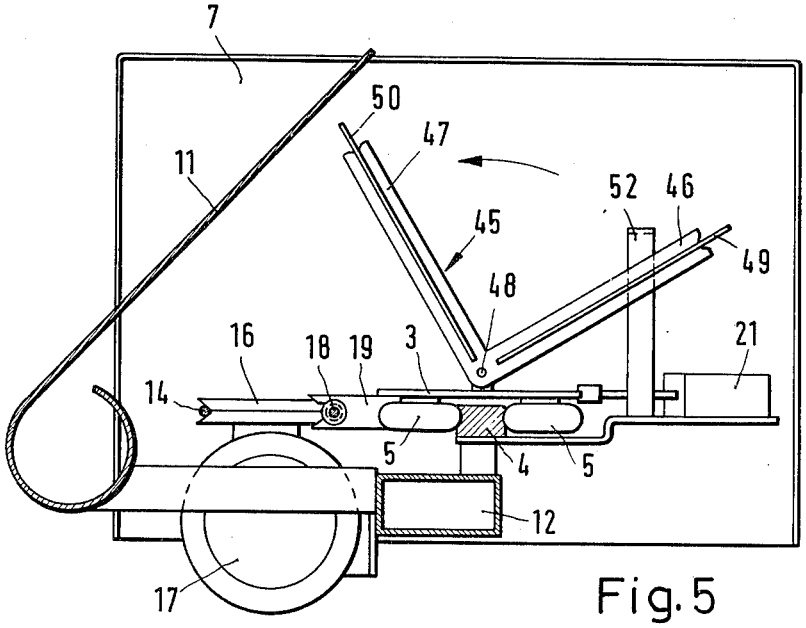
FIG. 5 shows a schematic sectional view of the target cart, whereby the target cart is pictured just before reaching the right end position.
Figure 6:
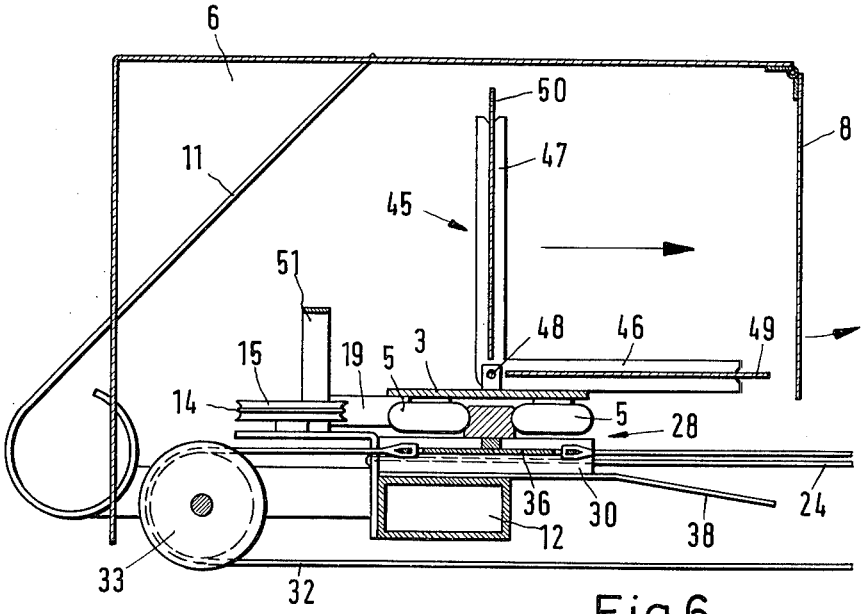
FIG. 6 shows a schematic sectional view of the shooting station, whereby the target cart is located in left end position.

As can be seen particularly from FIGS. 5 and 6, the target support 45 consists of two target holders 46 and 47 that are attached in fixed manner at right angles to one another. The target support 45 is pivoted onto the target cart 3 around a horizontal axis 48 parallel to the track 4, in such a way that it can assume two stable positions; in one position (FIG. 6), the target holder 47 is in vertical position and target holder 46 is turned forward to lie in horizontal position, while in the other position, the target holder 46 is in vertical position and target holder 47 is turned to the back to lie in horizontal position.

Each target holder consists of two slotted struts into which a target card may be placed. A target card 49 showing a boar running from right to left (FIG. 1) is placed in target holder 46, and a target card 50 showing a boar running from left to right is placed in target holder 47. Colored markings indicating the proper insertion of the target can be provided on the target card and the target holders, to avoid the possibility of mixing up the targets.

Located in the target houses 6 and 7 at each end of the path of movement of the target 3 is an obliquely ascending ramp 51 or 52. The ramp 51 in the left target house 6 is located beneath the path of travel of the target cart, at a point such that about half of the horizontal target holder 7, turned to the rear, runs up on it; the ramp 52 in the right target house 7 is located in front of the track 4 at a point such that about half of the horizontal target holder 6, turned to the front, runs up on it. Thus, when the target cart 3 moves into one or the other end position, the target holder that is in horizontal position runs up the corresponding ramp, whereupon it is raised (FIG. 5) until the center of gravity of the target support 45 has passed beyond the axis 48, whereupon the target support itself turns over into the other position. In this way, the correct target is always brought to vertical position automatically upon movement of the target cart 3 back and forth. Even if for some reason the target support 45 should assume an incorrect position, the proper position is reestablished at the latest after one lateral movement.

The described construction also automatically guarantees the proper position of the target support 45 when the target cart 3 is moved from the marksman's station 2 to the target station 1 on the target conveyor device 22. Since the first cross movement of the target cart 3 is from left to right following such transport of the target, the target 50 in the target holder 47 must be visible first. Therefore, target holder 45 must be flipped forward. Normally, the air resistance that forms during the rapid longitudinal movement of the target cart 3 is sufficient to flip the target support forward into this position. Should this fail to happen, however, then the flipping will take place at the latest when the target cart 3 passes through the curtain 8, as the curtain will push against the vertical target holder and definitely cause the support to flip if it is target holder 46 that is in question.

The use of the described target mechanism can be easily understood on the basis of the present description: Let us assume that in the beginning, the sliding carriage 28 of the target conveyor device 22 with the target cart 3 on it is located in forward end position at the marksman's station 2. The marksman inserts two target cards 49 and 50 into the target holders 46 and 47 of the target holder 45, paying attention to the proper positioning of the pictures; this is facilitated by the markings on the target support and the target card.

Then the marksman presses the button for longitudinal movement, activating the electric motor 35 to turn in the direction corresponding to the direction of movement of the sliding carriage 28 from the marksman's station to the shooting station. At first, the electric motor 35 runs at the higher speed, so that the target cart 3 moves rapidly backward; in the event that the target support 45 was flipped toward the back, it will be flipped forward by the air resistance, so that the target 50 becomes visible. Shortly before the target cart reaches the back end position, the timing relay switches the electric motor 35 to the lower speed, so that the sliding carriage 28 runs up softly against the end stops 26 and 27. As soon as it has reached this end stop, the target cart 3 activates the limit switch 20, whereupon the electric motor 35 is shut off.

Upon reaching end position, the fork 19 of the target cart engages with the spool-like cam 18 on the traction rope 14, whereupon the connection between the target cart 3 and the conveyor device 13 is produced; the fork member 42 has simultaneously pulled the pin 40 downward out of the aperture 43 in the target cart, so that the connection between the target cart 3 and the sliding carriage 28 is dissolved. The track 31 forms an extension of the track 4. Thus, the target cart 3 is ready for cross movement on the target station.

By pressing the button for cross movement, the marksman begins the cross movement. After the preset time lag, the electric motor 17 starts up and moves the target cart 3 out of the target house 6 at a steady speed, corresponding to the preset running time, over the firing zone 10 to the target house 7. During this time, the marksman can shoot at the moving target 50 that shows the running animal pointed in the proper direction.

When the target cart 3 enters the target house 7 at the end of its cross movement, the target holder 46, flipped forward, runs up against the ramp 52, whereupon the target support 45 is flipped into the back position so that now the other target card 49 is in vertical position. When it reaches the end position, the target cart 3 activates the limit switch 20, shutting off the electric motor 17.

When the marksman again presses the button for cross movement, the electric motor 17 starts up again in the opposite direction, so that the target cart now is moved from right to left across the firing zone 10 at the appropriate speed. The marksman can now shoot at the other target card 49, which once again depicts the animal running in the proper direction. When the cart reaches the target house 6, the target support 45 is again flipped forward by the ramp 51, and when it reaches its end position, the target cart 3 activates the limit switch 20, shutting off the electric motor.

This process can be repeated by the marksman as often as he wishes by pressing the button for cross movement.

If the marksman wants to check his hits or change the targets, he must first bring the target cart 3 to left end position in the target house 6, so that the target cart 3 is on the sliding carriage 28. Then he presses the button for longitudinal movement, whereupon the electric motor 35 starts up, rotating in the direction such that the sliding carriage 28 on the target conveyor device 22 is moved from the target station 1 to the marksman's station 2. Thereby, the connection between the fork 19 and the cam 18 is released automatically and the catch between the target cart 3 and the sliding carriage 28 is produced in that the fork member 44 permits the pin 40 to move upward. In the case of this longitudinal movement, too, the motor 35 first runs at the higher speed, moving the target cart 3 rapidly over the greater part of the stretch. Shortly before it reaches the end position, the time relay switches the electric motor 35 to the lower speed, so that the sliding carriage 28 runs smoothly into its end position, in which the target cart 3 activates the limit switch 39, shutting off the electric motor 35. Now we are back at the starting position described earlier, and all the processes can be repeated in the manner described.

Of course, the master switches for the electric motors 17 and 35 are designed in such a way that any accidental release is prevented. For instance, the electric motor 17 for lateral movement can only be turned on when either limit switch 20 or limit switch 21 is activated, and the electric motor 35 for longitudinal movement can only be turned on when either limit switch 20 or limit switch 39 is activated.

What is claimed is:

1. A target mechanism for a shooting range having a marksman's station and a target station, comprising a transverse guide means mounted on the target station transversely of the line of fire, a target cart mounted for movement along the transverse guide means between two end positions, a transverse drive mechanism for moving the target cart in either direction on the transverse guide means, a motor for driving the transverse drive mechanism, a longitudinal guide means extending between the marksman's station and the target station adjacent to one end of the transverse guide means, a sliding carriage mounted for reciprocating movement along the longitudinal guide means from the target station and the marksman's station between two end positions, the sliding carriage being adapted to receive the target cart when it is in its one end position at the target station, a longitudinal drive mechanism connected with the sliding carriage for moving it along the longitudinal guide means between its two end positions, and a motor for driving the longitudinal drive mechanism.

2. A target mechanism according to claim 1, in which the transverse guide means comprises at least one crossrail.

3. A target mechanism according to claim 2, in which the sliding carriage has a crossrail section which forms an extension of the crossrail on the target station when the carriage is in said one end position, the transverse drive mechanism being designed in such a way that the target cart is positioned on the crossrail section of the sliding carriage when the cart is in said one end position.

4. A target mechanism according to claim 1, in which the longitudinal guide means consists of suspension wires stretched between the target station and the marksman's range.

5. A target mechanism according to claim 1, comprising means for releasably connecting said target cart to said transverse drive mechanism, the said means being adapted to interlock automatically for establishing the connection when the sliding carriage moves into said one end position at the target station and to release automatically for separating the connection when the sliding carriage leaves the said one end position.

6. A target mechanism according to claim 5, in which the transverse drive mechanism has a traction rope extending parallel to the transverse guide means, said releasable connection means comprising a cam fixed to the traction rope and adapted to engage a horizontal fork mounted on the target cart.

7. A target mechanism according to claim 1, comprising a catch device for the target cart on the sliding carriage, which catch locks automatically when the sliding carriage leaves said one end position adjacent to the target station and which releases automatically when the sliding carriage returns to the said one end position.

8. A target mechanism according to claim 7, in which the catch comprises a spring-loaded pin mounted for vertical movement on the sliding carriage, which pin can lock into an aperture on the target station end of the longitudinal guide.

9. A target mechanism according to claim 1, in which said motor driving the transverse drive mechanism is an electrical motor, and in which a limit switch for shutting off the electrical motor is mounted at each end of the transverse guide means in the path of the target cart, said limit switches being arranged to be actuated by the target cart reaching either of its respective end positions.

10. A target mechanism according to claim 1, in which said motor driving the longitudinal drive mechanism is an electric motor, and in which a limit switch for turning off the electric motor is arranged at each end of the longitudinal guide means, said limit switches being arranged to be actuated by said sliding carriage reaching its respective end position.

11. A target mechanism according to claim 1, comprising a target support with two target holders rigidly interconnected at right angles to one another, said target support being mounted on the target cart for pivotal movement about a horizontal axis parallel to the transverse guide means in such manner that it can assume two positions, in which either one or the other of the two target holders is in vertical position, and in that there is a device at each end of the transverse guide means for flipping over the target support when said target cart reaches its respective end position.

12. A target mechanism according to claim 11, in which each flipping device consists of a ramp against which the target holder runs up when in horizontal position.

13. A target mechanism according to claim 11, in which the entry opening through which the target cart on the longitudinal guide means runs into the target station is covered by a curtain that lies in the path of the target holder in vertical position.

* * * * *